US005201199A

United States Patent [19]

Kemper

[11] Patent Number: 5,201,199

[45] Date of Patent: Apr. 13, 1993

[54] WARP KNITTING MACHINE WITH DIFFERENTLY RESONANT SPRINGS

[75] Inventor: Rainer Kemper, Obertshausen, Fed. Rep. of Germany

[73] Assignee: Karl Mayer Textilmaschinenfabrik GmbH, Obertshausen, Fed. Rep. of Germany

[21] Appl. No.: 938,713

[22] Filed: Sep. 1, 1992

[30] Foreign Application Priority Data

Sep. 10, 1991 [DE] Fed. Rep. of Germany ..... 4130030

[51] Int. Cl.[5] ..... D04B 23/00; F16F 7/12

[52] U.S. Cl. ..... 66/204; 139/82; 188/380; 267/175

[58] Field of Search ..... 66/204, 205, 207, 208; 139/82, 83, 84; 188/380; 267/168, 172, 175

[56] References Cited

U.S. PATENT DOCUMENTS 2,170,697 8/1939 Richter ..... 66/204
2,941,386 6/1960 Hold ..... 66/204
3,933,345 1/1976 Fidi et al. ..... 267/168
4,344,307 8/1982 Bucher et al. ..... 66/207 X
4,858,459 8/1989 Takahashi ..... 188/38 X

FOREIGN PATENT DOCUMENTS 0133966 3/1985 European Pat. Off. ..... 139/82

*Primary Examiner*—Clifford D. Crowder
*Assistant Examiner*—John J. Calvert
*Attorney, Agent, or Firm*—Omri M. Behr; Matthew J. McDonald

[57] ABSTRACT

Warp knitting machine comprising at least one guide bar axially displaceable by a pattern drive and a return spring acting thereon. At least two separate springs acting in combination upon the guide bar, have different resonant frequencies. Furthermore, they have independently adjustable, effective spring forces. By this means, it is possible to obtain a higher rate of revolution for the warp knitting machine then was heretofore possible.

8 Claims, 1 Drawing Sheet

WARP KNITTING MACHINE WITH DIFFERENTLY RESONANT SPRINGS

FIELD OF THE INVENTION

The present invention is directed to a warp knitting machine having at least one guide bar which is axially displaceable by a pattern drive, and a return spring supported by the machine frame, which urges the guide bar toward a patterning element of the patterning drive.

DISCUSSION OF THE PRIOR ART

In the warp knitting machines known to the art (DE PS 36 34 021) the axial motion produced by the profiled outer surface of the patterning element, (for example a pattern plate or pattern chain), is applied to a guide bar via a contact roller, a pattern cam follower and a push rod having a hinged bearing at each end. To ensure the contacting force between the contact roller and the patterning element, a return spring is provided between the machine frame and the guide bar.

Rapidly running warp knitting machines operate at a main shaft rate of 2400 revolutions/minute, that is, 40 working cycles per second. Attempts to obtain higher machine speeds led to collisions between the guides and the needles.

A purpose of the present invention is to provide an improved and accurate control of the guide bars at higher machine speed.

SUMMARY OF THE INVENTION

In accordance with the illustrative embodiments demonstrating features and advantages of the present invention, there is provided a warp knitting machine having a machine frame and at least one guide bar mounted to reciprocate upon the machine frame. The machine also has a patterning drive with a patterning element for axially displacing the guide bar. Also included is a return spring means mounted on the machine frame for urging the guide bar toward the patterning element of the patterning drive. This return spring includes at least two separate springs mounted to act in combination upon the guide bar. These two springs have different resonant frequencies.

The preferred return springs are strong enough, despite the acceleration forces generated by the guide bar, to maintain the contacting force on the patterning drive, in particular the contact roller and the patterning element. Furthermore, the pressure generated by the preferred return spring should vary as little as possible during a work cycle, which requires a low spring constant. Both of these requirements give rise to a low resonance frequency of the return spring. In the circumstances where the working speed of the warp knitting machine is high, the excitation frequency of the machine approaches this resonant frequency. Consequently, the spring force, and with it the contact force, are reduced.

Given that the spring constant and the resonant frequency of a spring are calculated with the same variables, low spring constants generally leads to corresponding low resonant frequencies. Where one is dealing with relatively rapid machine rotations, there is a corresponding danger that the excitation frequency will approach the resonant frequency.

In light of these resonance phenomena, the preferred structure employs at least two individual springs acting simultaneously, but with different resonant frequencies.

In the preferred embodiment as illustrated, the springs are shown to be both coaxial with each other and with the push rod, and serially arranged. These latter orientations, however, are not essential to the invention. It is merely necessary that the axes of the springs, when not coaxial, are work in combination on the push rod. Thus the springs may be radially spaced and parallel, or angled, so long as they work together, on the push rod, either directly or indirectly.

Thus, it is possible to keep the above described loss as low as possible over the entire rotational speed range of the warp knitting machine. This is because only one spring at a time can ever be excited to its own resonant frequency; the remaining single spring maintains the necessary contact force between the patterning element and the guide bar.

In particular, the desired spring constant can be obtained by the combination of a somewhat stiffer and a somewhat softer individual spring so that both of the resonant frequencies of both of the individual springs lie outside the excitation frequency of the operating point of the machine It is advantageous when these (at least) two individual springs can be individually tensioned. It is thus possible to set the springs in accordance with the process requirements.

It is advantageous to provide the individual springs as compression springs, which exercise spring tension forces on the guide bar through a twin armed lever. By this mode of construction it is possible to transfer substantially larger forces onto the guide bar. When the twin armed lever is an angled lever, the compression springs can be oriented on a vertical axis and thus save space.

In a preferred embodiment, a push rod acts upon a twin armed lever and penetrates a first wall affixed to the frame. A first screw-adjustable, single spring extends between a bearing surface on this wall and a bearing surface on the push rod proximal to its connection point with the lever. A second screw-adjustable, single spring is located between the bearing surface of a second wall attached to the frame and a bearing surface on the push rod distal to its connection with the lever. This gives rise to a slender spring outline with the greater dimension along the push rod axis, and a smaller space requirement perpendicular to the push rod axis.

When the bearing surface on the push rod proximal to the lever and/or the bearing surface of the second wall attached to the machine frame, is threadably adjustable, one obtains the simple possibility of adjusting the springs in a highly advantageous manner to account for process requirements.

BRIEF DESCRIPTION OF THE DRAWINGS

The present invention will be more fully appreciated by reference to the detailed description and the accompanying drawings, wherein.

DETAILED DESCRIPTION OF THE PREFERRED EMBODIMENTS

Figure 1:
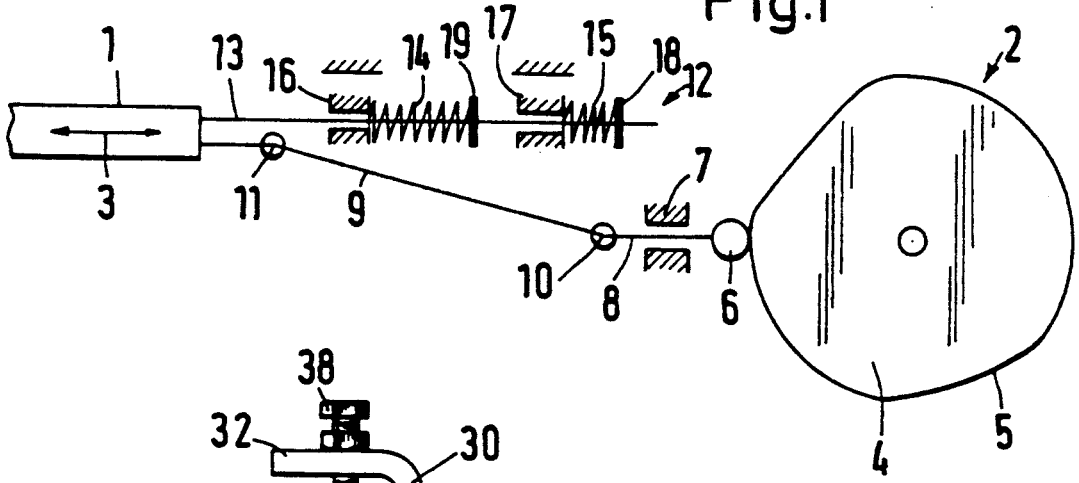
FIG. 1 is schematic representation of the portion of the warp knitting machine relating to the present invention.

In FIG. 1 a guide bar 1 is driven to and fro in the direction of the double arrow 3 by pattern drive 2. The pattern drive comprises a pattern disk 4 with a profiled outer surface 5 against which the contact roller 6 is pressed. Disk 4 is driven by the machine main shaft (not shown) to properly synchronize shogging of guide bar 1. The movement of roller 6 is transferred onto guide bar 1 with the assistance of a pattern cam follower 8 carried in guide 7 located in the machine frame and a push rod 9 having hinged bearings 10 and 11 at each end thereof.

The contact force between contact roller 6 and pattern disk 4 is achieved by the assistance of a return spring 12 which transmits a spring tensioning force via transfer element 13 onto guide bar 1. Return spring 12 comprises two separate springs 14 and 15 which bear against the bearing surface 16 and 17 on the machine frame and the bearing surfaces 18 and 19 on the transfer element 13. The two bearing surfaces 16 and 17 are adjustable relative to the frame. Both individual springs are in the form of compression springs. They have different resonant frequencies.

Figure 2:
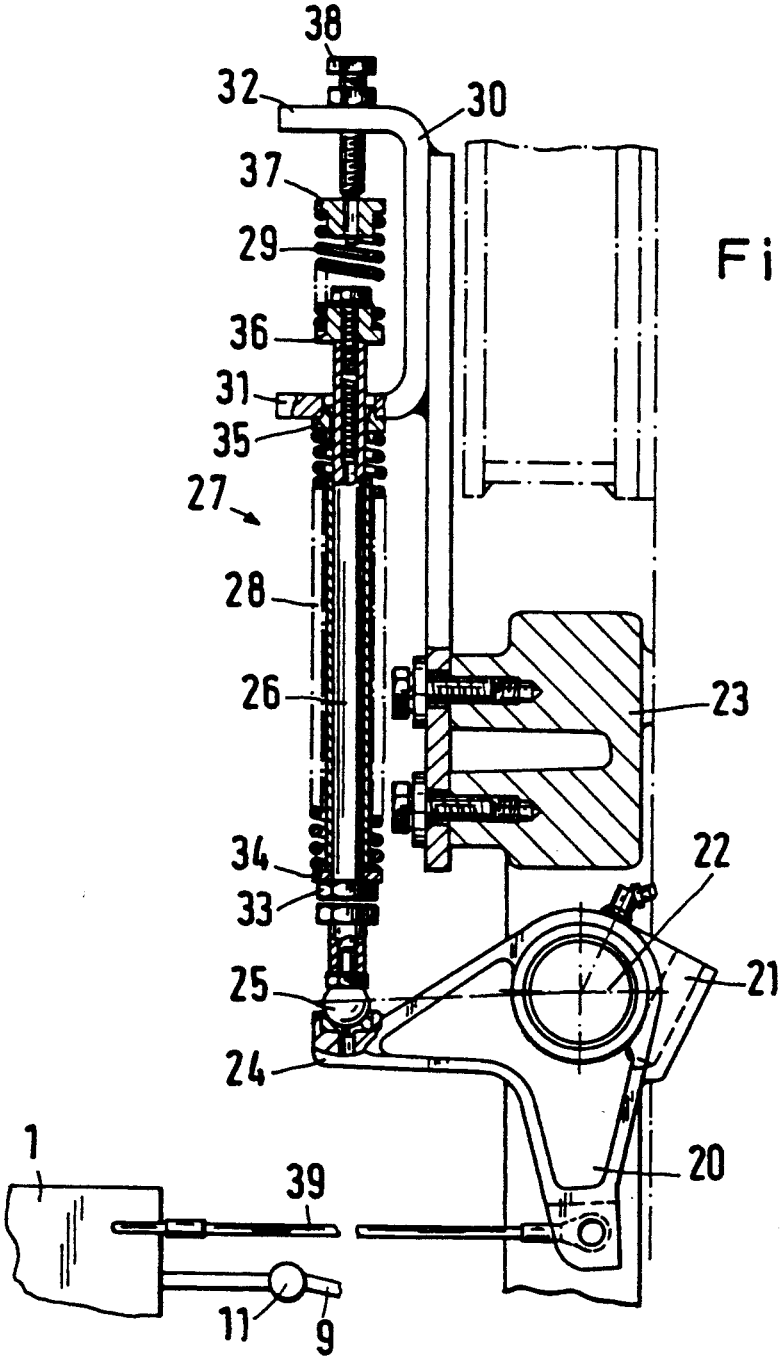
FIG. 2 is a structural representation of the portion of the machine of FIG. 1 relating to the return spring.

In the structural embodiment in accordance with FIG. 2, guide bar 1 connects to tension rod 39 which is a rod pivotally connected with arm 20 of twin-armed, angle lever 21. Lever 21 is rotatable about axle 22 on machine frame 23. The other arm 24 connects to contact point 25, which is in the form of a ball joint. Joint 25 is connected to transfer force to push rod 26. A pair of screw-adjustable, single springs 28 and 29 comprise the return spring 27. Upon the frame, there is provided a U-shaped bracket 30 with two frame walls 31 and 32. The single spring 28 encircles rod 26 and extends between first bearing surface 35 and third bearing surface 34. Surface 35 is part of a bushing mounted into a hole in frame wall 31 of bracket 30. Third bearing surface 34 is shown as the upper surface of threadably adjustable nuts 33, which are threaded onto rod 26 proximate to the contact point 25 on lever 21.

The separate spring 29 extends between second bearing surface 37 and fourth bearing surface 36. Surface 36 is shown as a flanged plug screwed onto the end of rod 26 distal to the contact point 25. Second bearing surface 37 is a flanged plug fitted into spring 29 and supported against frame wall 32 via screw 38.

Individual springs 28 and 29 have different structure and thus have different resonant frequencies. By adjusting the position of bearing surfaces 34 and 37, it is possible to adjust each of the individual springs 28 and 29 to the specific data of the warp knitting machine.

Generally speaking, it is sufficient to utilize two separate springs adjusted to work in combination on rod 26. Special cases, however, may utilize three or more springs. Moreover, the springs may be mounted apart from rod 26 and need not be coaxial. For example, the springs may be skewed from the rod axis and employ separate mechanisms to apply their spring force to the rod 26 or lever 21.

I claim:

1. A warp knitting machine comprising:

a machine frame;

at least one guide bar mounted to reciprocate upon said machine frame;

a patterning drive having a patterning element for axially displacing said guide bar; and a return spring means mounted on the machine frame for urging said guide bar toward said patterning element of the patterning drive, said return spring including:

at least two separate springs mounted to act in combination upon said guide bar, said two springs having different resonant frequencies.

2. A warp knitting machine in accordance with claim 1, wherein said two springs have independently adjustable effective spring force.

3. A warp knitting machine in accordance with claim 1, comprising:

a twin armed lever coupled to said guide bar, said two springs being compression springs coupled to said lever for applying force through said lever to said guide bar.

4. A warp knitting machine in accordance with claim 2, comprising:

a twin armed lever coupled to said guide bar, said two springs being compression springs coupled to said lever for applying force through said lever to said guide bar.

5. A warp knitting machine in accordance with claim 4, wherein said machine frame has a first and second frame wall with a first and second bearing surface, respectively, said machine comprising:

a push rod slidably mounted through said first frame wall and connected to said twin armed lever, said push rod having proximal and distal to its connection with said lever a third and fourth bearing surface, respectively, a first one of said springs extending between said first bearing surface of said first frame wall and the third bearing surface on the push rod, a second one of said springs extending between said second bearing surface of said second frame wall and said fourth bearing surface of said push rod.

6. A warp knitting machine in accordance with claim 5, wherein the third bearing surface on said push rod 26 can be threadably displaced relative to said twin armed lever.

7. A warp knitting machine in accordance with claim 5 wherein said second bearing surface of said second frame wall can be threadably displaced.

8. A warp knitting machine in accordance with claim 6 wherein said second bearing surface of said second frame wall can be threadably displaced.

* * * * *